US008413845B1

(12) United States Patent
Duncan et al.

(10) Patent No.: US 8,413,845 B1
(45) Date of Patent: Apr. 9, 2013

(54) DUAL-COMPARTMENT DISPENSING CONTAINER

(76) Inventors: Thomas J. Duncan, Toms River, NJ (US); Norman Usen, Marlboro, NJ (US); Anthony E. Winston, East Brunswick, NJ (US)

( * ) Notice: Subject to any disclaimer, the term of this patent is extended or adjusted under 35 U.S.C. 154(b) by 288 days.

(21) Appl. No.: 12/804,140

(22) Filed: Jul. 14, 2010

Related U.S. Application Data

(60) Provisional application No. 61/271,382, filed on Jul. 20, 2009.

(51) Int. Cl.
*B65D 35/22* (2006.01)
*B65D 35/00* (2006.01)

(52) U.S. Cl. ..... 222/94; 222/107

(58) Field of Classification Search ..... 222/94, 222/129, 137, 325–327, 92, 107
See application file for complete search history.

(56) References Cited

U.S. PATENT DOCUMENTS

| | | | | |
|---|---|---|---|---|
| 1,894,115 | A * | 1/1933 | Murphy | 222/94 |
| 2,939,610 | A * | 6/1960 | Castelli et al. | 222/94 |
| 3,175,731 | A * | 3/1965 | Ellman | 222/94 |
| 3,206,074 | A * | 9/1965 | Hoffmann | 222/94 |
| 3,290,422 | A * | 12/1966 | Michel | 264/259 |
| 3,442,424 | A * | 5/1969 | Prussin et al. | 222/81 |
| 5,628,429 | A | 5/1997 | Usen et al. | 222/1 |
| 5,860,565 | A | 1/1999 | Winston et al. | 222/1 |
| 6,124,008 | A * | 9/2000 | Barre | 428/35.7 |
| 6,176,395 | B1 | 1/2001 | Abbott et al. | 222/94 |
| 6,210,621 | B1 | 4/2001 | Usen et al. | 264/263 |
| 6,257,450 | B1 | 7/2001 | Jackson et al. | 222/94 |
| 6,308,862 | B1 | 10/2001 | Fillmore et al. | 222/94 |
| 6,345,733 | B1 | 2/2002 | Bennett | 222/94 |
| 6,347,726 | B1 | 2/2002 | Jackson et al. | 222/94 |
| 6,846,443 | B1 | 1/2005 | Jackson et al. | 264/242 |
| 6,905,323 | B2 | 6/2005 | Keller | 425/112 |
| 7,021,032 | B2 | 4/2006 | Linner | |
| 7,044,333 | B2 | 5/2006 | Johns et al. | 222/92 |
| 7,337,925 | B2 * | 3/2008 | Imaizumi et al. | 222/145.3 |
| 2003/0106903 | A1 * | 6/2003 | Chan et al. | 222/94 |
| 2007/0267436 | A1 * | 11/2007 | Abbott et al. | 222/94 |

FOREIGN PATENT DOCUMENTS

| | | | |
|---|---|---|---|
| FR | 2676210 | A1 * | 11/1992 |
| JP | 63272670 | A * | 11/1988 |
| JP | 03162248 | A * | 7/1991 |

* cited by examiner

*Primary Examiner* — Paul R Durand
*Assistant Examiner* — Matthew Lembo
(74) *Attorney, Agent, or Firm* — Frenkel & Associates, PC

(57) ABSTRACT

A dual-compartment dispensing container for retaining and dispensing two separate products or product phases such that each product or product phase is concurrently dispensed from each compartment in substantially equal volumetric amounts. The first compartment comprises a deformable semi-circular inner tube having a top end and a bottom end. The inner tube is disposed within a second compartment comprising a deformable fully circular outer tube having a top end and a bottom end.

19 Claims, 7 Drawing Sheets

DUAL-COMPARTMENT DISPENSING CONTAINER

CROSS-REFERENCE TO RELATED APPLICATION

This application claims the benefit of the filing date of Provisional Application Ser. No. 61/271,382 filed Jul. 20, 2009, the disclosure of which is incorporated herein by reference in its entirety.

FIELD OF THE INVENTION

The invention relates to a dual-compartment dispensing container that is useful for dispensing approximately equal volumetric amounts of separate products or product phases contained in each compartment. The dispensing container is quite useful for dispensing those products and product phases that would prematurely interact or decompose if they came into contact during storage. Exemplary products include toothpastes containing baking soda and peroxide which would otherwise react and decompose prior to application in the mouth, two-part epoxy glues, monomer-polymerization catalyst compositions, two-part hair colorants, two-part skin preparations, two-part food condiments and the like.

BACKGROUND OF THE INVENTION

U.S. Pat. No. 4,687,663 pertains to a dual-compartment dispensing container wherein a hydrogen peroxide phase and a baking soda phase are simultaneously dispensed from the container.

U.S. Pat. No. 4,538,920 pertains to dual-dispensing containers consisting of two coupled syringes.

U.S. Pat. Nos. 5,020,694, 5,038,963, 5,289,949, 5,335,827 and 5,645,193 pertain to dual-dispensing containers having pump cartridges containing the products to be delivered using pistons to deliver the products.

U.S. Pat. No. 6,345,733 pertains to a dual-compartment dispensing container formed from a single deformable tube with opposite ends of the tube being used are the openings for each compartment.

U.S. Pat. No. 6,308,862 pertains to a compressible dual-compartment dispensing container in which two flexible pouches containing the products are present within the outer compartment.

U.S. Pat. Nos. 6,347,726, 6,257,450 and 6,176,395 pertain to dual-compartment dispensing containers in which the outer tube contains one phase of the product and an inner tube contains the other phase.

U.S. Pat. Nos. 5,702,033, 5,899,361, 5,594,231 and 6,065,643 pertain to dual compartment dispensing containers containing dual-dispensing tubes located side-by-side within the container.

U.S. patents Re. 36035, 5,860,565 and 7,044,333 pertain to dual-compartment dispensing containers wherein two compartments are formed within a single conventional tube using a central plastic tube divider.

OBJECTS OF THE INVENTION

It is the principal object of this invention to provide an inexpensive dual-compartment dispensing container that will effectively dispense approximately equal volumetric amounts of products or product phases contained in each compartment.

The foregoing object and other objects not listed above have been met by this invention that is described in detail below.

SUMMARY OF THE INVENTION

The invention pertains to a dual-compartment container for storing and dispensing different products or different product phases from each compartment. The products or product phases in each compartment will typically be present in the form of creams, pastes, or gels. The products or product phases will be of the type that are otherwise incompatible or would prematurely react or decompose if they were stored in a single-compartment container. The container of the invention is capable of simultaneously dispensing approximately equal volumetric amounts of each product or product phase from each compartment.

The container of the invention comprises two tubes: a conventional outer tube and a semi-circular inner tube installed in the cavity of the outer tube and taking up approximately half its volume. The outer surface of the semi-circular wall of the inner tube conforms to and abuts the inner surface of the outer tube and the flat wall of the inner tube divides the space within the outer tube in half. One of the products or product phases is placed in the inner tube while the other product or product phase is placed in the cavity of the outer tube that is not occupied by the inner tube.

The container has the following features:

(a) In order to make the entire container as compact as possible, the inner tube has a semi-circular configuration throughout most, e.g., about 95-99%, of its overall length. At the top of the inner tube, the semi-circular configuration expands and thickens into a shoulder that has a fully circular configuration. The shoulder has a thickness of 0.010-0.060, preferably 0.015-0.045, inch.

(b) The shoulder and neck of the inner tube occupies about 1-10% of the overall length of the inner tube and conforms to and abuts the inner surface of the shoulder of the outer tube. The shoulder of the inner tube narrows at its end into a fully circular neck that fits snugly into the neck of the outer tube.

(c) The semi-circular wall of the inner tube is comprised of a readily-deformable material such as a thin (e.g., 0.006-0.025 inch thickness) flexible thermoplastic polymer, e.g., polyethylene, polypropylene, etc., with the thickness being dependent on the particular selected thermoplastic polymer. The semi-circular wall of the inner tube is more easily deformed than the wall of the outer tube (as further described below).

(d) The semi-circular portion of the inner tube terminates in a flat wall (also referred to herein as the "spine"). The spine is semi-rigid and extends the entire length of the inner tube, i.e., from its bottom end, through the shoulder into the opening of the neck, thereby dividing the opening of the neck into two equal halves. The spine has a thickness of 0.010-0.045 inch.

(e) Below the shoulder, the width of the spine is equal to the inner diameter of the outer tube. In the shoulder and neck portions of the inner tube, the width of the spine follows the cross-sectional width of the shoulder and the neck of the inner tube at any given point.

(f) The outer diameter of the neck of the inner tube is slightly larger, e.g., by about 0.001-0.005 inch, than the inner diameter of the neck of the outer tube. The neck of the inner tube friction-fits or press-fits into the neck of the outer tube, thereby insuring that the inner tube is firmly held in place.

(g) The space in the outer tube that is not occupied by the inner tube serves as the second compartment for storage of the second product or product phase.

(h) The inner tube divides the space within the outer tube from the end of the container up through the shoulder and neck of the outer tube into two compartments such that the cross-sectional area of the space within each compartment is approximately equal throughout the length of the container.

(i) The volumes of the inner and outer compartments are approximately equal.

(j) The neck of the inner tube provides for two openings, one allowing egress of the first product or product phase from the inner compartment, the other allowing egress of the second product or product phase from the outer tube. Thus, the spine of the inner tube divides the inner shoulder and neck into two equal halves. One semi-circular section opening leads from the inner compartment through the semi-circular section of the neck bounded by the inner side of the spine. The other semi-circular section opening leads from the second compartment through the other semi-circular portion of the neck bounded by the outer side of the spine wall.

(k) The outer tube is standard in nature and is fabricated from a thermoplastic polymer-laminated aluminum (e.g., polyethylene-laminated aluminum) or a thermoplastic polymer, e.g., polyethylene or polypropylene; preferably, it is polyethylene-laminated aluminum. The thermoplastic polymer selected for the fabrication of the inner tube must be compatible with the material selected for the fabrication of the outer tube, since, after filling the inner and outer tubes with the selected products or product phases, the end of the container is crimped and sealed. It is not feasible to seal two different thermoplastic polymers such as polyethylene and polypropylene. Therefore, it is preferred that the inner tube be fabricated from polyethylene and the inner side of the outer laminated tube be coated with polyethylene.

(l) When the outer tube is fabricated from polyethylene-laminated aluminum, the wall thickness will be about 0.008-0.015, preferably 0.010-0.013, inch. When the outer tube is fabricated from a thermo-plastic polymer, the wall thickness will be about 0.010-0.030, preferably 0.012-0.020 inch.

(m) The openings in the neck for the inner and outer tubes have a single closure such as a screw or flip-top cap.

In one embodiment of the invention, the neck of the inner tube fits completely through the neck of the outer tube such that the top of the neck of the inner tube and the top of the neck of the outer tube are substantially aligned.

In a preferred embodiment of the invention, the top of the neck of the outer tube ends in a circular collar which thereby reduces the diameter of the opening of the container. In this embodiment, the diameter of the opening through the neck of the inner tube is substantially equal to or greater than the diameter of the opening through the collar of the outer tube. Furthermore, the length of the neck of the outer tube is greater than the length of the neck of the inner tube by an amount substantially equal to or greater than the thickness of the outer tube's collar. Accordingly, when the inner tube is inserted into the outer tube, the top of the neck of the inner tube fits snugly up against the collar of the outer tube or may not quite reach the collar. In either case, this allows the outside of the shoulder of the inner tube to abut the inside of the shoulder of the outer tube.

Preferably, the spine extends slightly, e.g., about 0.001 to 0.060 inch, beyond the top of the opening in the neck or, if present, beyond the collar of the outer tube, to insure that a barrier is present to fully separate the two compartments when the closure is in place and the container is sealed.

In a further embodiment of the invention, the spine has extensions on each side of the inner tube. The extensions serve to press against the inner wall of the outer tube to thereby prevent migration of the product or product phase in the outer tube to the area behind the semi-circular wall of the inner tube adjacent to the inner wall of the outer tube. Preferably, the extensions are designed to fold away from the spine. When flattened as a result of crimping, the extensions are designed such that the ends of the extensions reach the ends of the crimp. Thus, the widths of the two extensions and the width of the spine are substantial equal to one-half of the circumference of the outer tube. Such design insures that the same thickness of material is present in the crimp across the entire width of the container.

As mentioned above, the compositions that are stored and dispensed from the inner and outer tubes may be any products or product phases that would prematurely interact or decompose if they came into contact during storage. The low cost dual-compartment dispensing container of the invention is particularly useful for storing and dispensing of products or product phases in the form of creams, pastes or gels. The container of the invention is especially suitable for storing and dispensing two-phase toothpastes such as baking soda-peroxide toothpastes and two-phase oral care fluoride compositions.

The flexibility of the wall of the inner tube is such that it is more easily deformed than the wall of the outer tube. This ensures that when pressure is applied to each side of the wall of the outer tube, the pressure on the compositions in the outer and the inner tubes will be equal, thereby resulting in even delivery of each product or product phase from the outer tube and the inner tube. The force required to dispense the products or product phases from the outer and inner tubes will vary depending on the rheological characteristics of the products or product phases being dispensed. Typically, the force required to dispense the products or product phases from the inner and outer tubes will be in the range of about 0.5 to 20 pounds.

In order for the products or product phases to be dispensed evenly from the inner and outer tubes, the rheology of the two products or product phases should be substantially similar and the pressure imposed upon the inner and outer tubes should be substantially equal. The latter can be ensured by appropriate adjustments to the inner and outer tubes such as by modification of the wall thickness of the inner tube to ensure that the force required to dispense a product or product phase from the inner tube is $\leqq 90\%$ of the force required to dispense the product or product phase from the outer tube. Accordingly, when sufficient pressure is applied to the outer tube to dispense a product or product phase, the force experienced on the product or product phase in each tube will be similar and therefore, the products or product phases will be evenly dispensed from the inner and outer tubes.

As mentioned above, the inner tube is preferably fabricated as a single unit by injection molding, but it may be made from separate components and assembled. The complete dual-compartment dispensing container of the invention is assembled by inserting the inner tube into the outer tube such that the neck of the inner tube fits snugly into the neck of the outer tube and the shoulder of the inner tube fits snugly against the inside of the shoulder of the outer tube. Also, if a collar is present on the neck of the outer tube, the top of the neck of the inner tube may fit snugly against the collar or may not quite reach the collar.

For most compete products, the outer surfaces of the containers of the invention are lithographed with various types of information, e.g., product name, trademarks, directions for use, ingredients, warnings, product claims, net weight, etc. Preferably, the spine of the inner tube divides the front and back lithographed panels of the outer tube and is parallel with the tube crimp and seal.

Before filling, in order to seal the dispensing end of the container, the cap is affixed, e.g., screwed, onto the neck of the outer tube. This is usually done prior to insertion of the inner tube, but it may be done after insertion of the inner tube.

After the container has been fabricated and assembled, the inner and outer tubes are filled with the desired compositions though the open ends of the tubes. Standard tube-filling equipment may be used to fill the inner and outer tubes. Preferably, dual-head filling equipment is employed to simultaneously fill both the inner and the outer tubes. Alternatively, the inner and outer tubes may be consecutively filled by running the tubes between separate single-product filling stations. After filling, the ends of the inner and outer tubes are simultaneously crimped and sealed to form a permanent closure at the bottom of the container. Many types of prior art sealing equipment are available for sealing plastic and plastic-aluminum laminate tubes such as by heating, radio-frequency waves, ultrasonic radiation and the like.

DESCRIPTION OF THE DRAWINGS

Throughout the drawings, like reference letters pertain to like parts.

Figure 1:
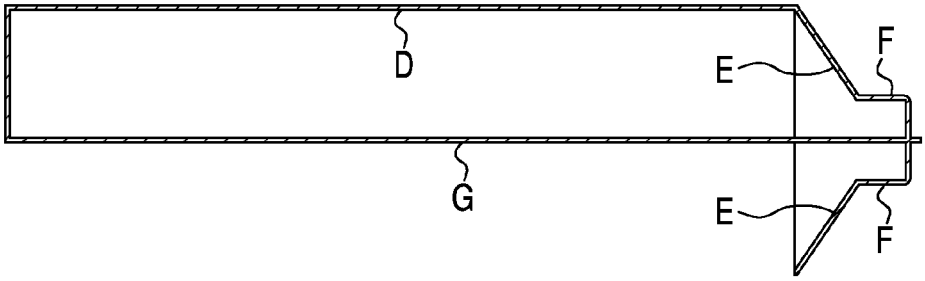
FIG. 1 is a cross-sectional view of the inner tube of the container.
Figure 2:
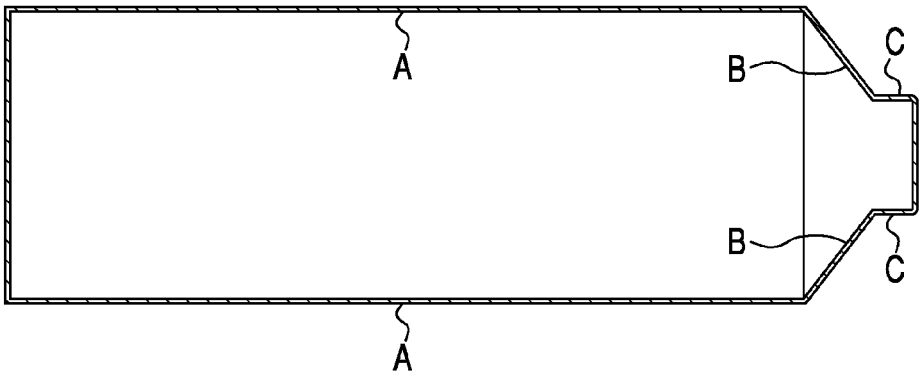
FIG. 2 is a cross-sectional view of the outer tube of the container.
Figure 3:
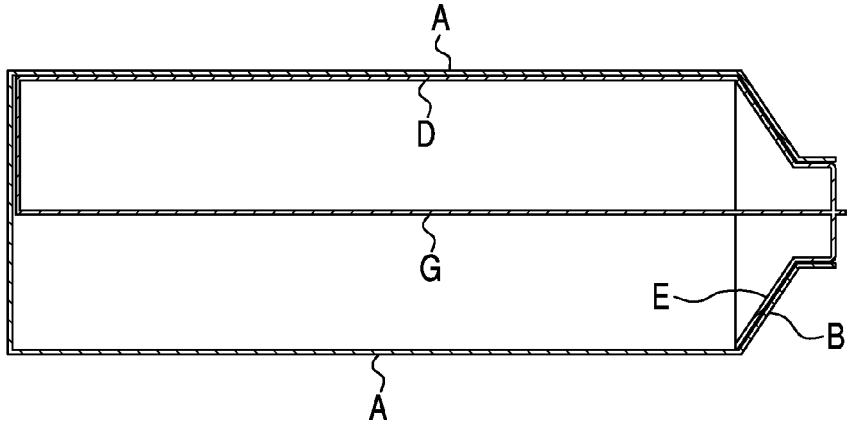
FIG. 3 is a cross-sectional view of the container showing the inner tube inserted in the outer tube.
Figure 4:
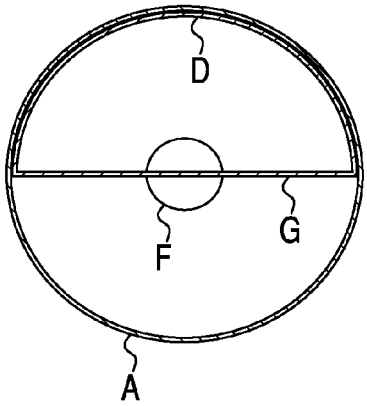
FIG. 4 is a cross-sectional view of the bottom of the container before the inner and outer tubes are filled.
Figure 4A:
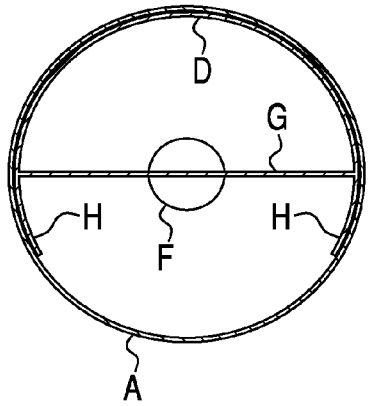
FIG. 4A is a cross-sectional view of the bottom of the container before the inner and outer tubes are filled, showing the optional extensions.
Figure 5:
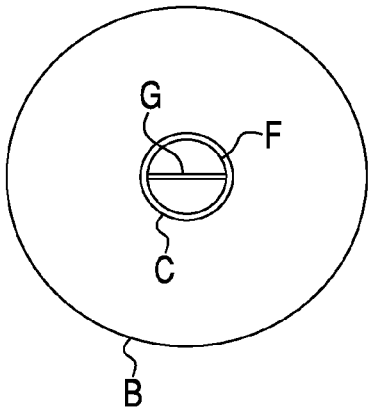
FIG. 5 is a cross-sectional view of the top of the container.
Figure 6:
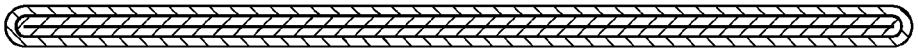
FIG. 6 is a cross-sectional view of the bottom of the container after its end has been crimped.
Figure 6A:
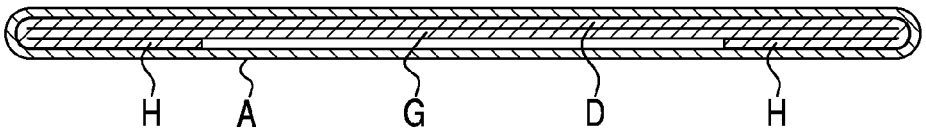
FIG. 6A is a cross-sectional view of the bottom of the container after its end has been crimped, showing the optional extensions.
Figure 7:
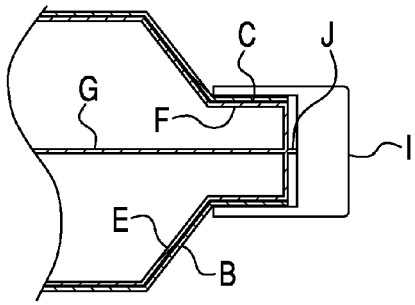
FIG. 7 is a cross-sectional view of the top of the container showing the closure.
Figure 8:
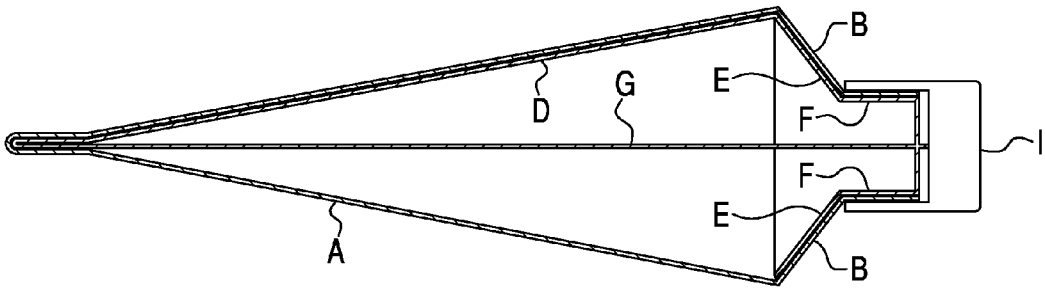
FIG. 8 is a cross-sectional view of the entire container.
Figure 9:
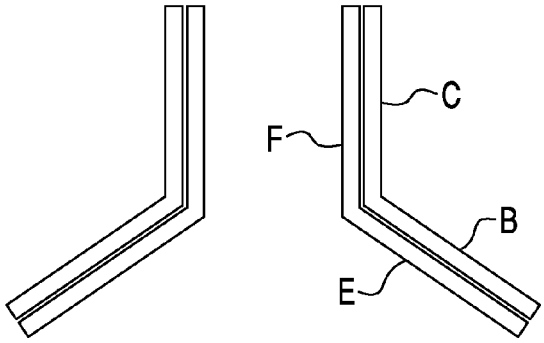
FIG. 9 is a cross-sectional view of the top of the container showing the outer and inner shoulder and neck (without any collar) configuration.
Figure 9A:
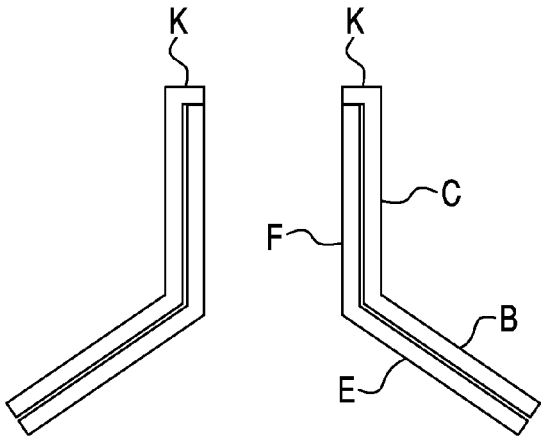
FIG. 9*a* is a cross-sectional view of the top of the container showing the outer and inner shoulder and neck (with the collar) configuration and illustrates the embodiment of the neck fitting up against the collar.
Figure 9B:
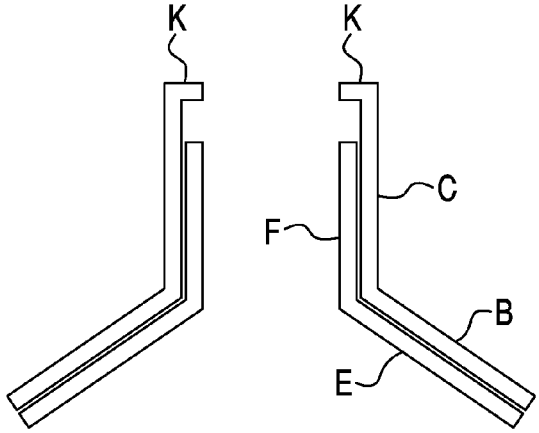
FIG. 9*b* is a cross-sectional view of the outer and inner shoulder and neck of the container (with the collar) configuration and illustrates the embodiment of the neck of the inner tube not quite reaching the collar.
Figure 9C:
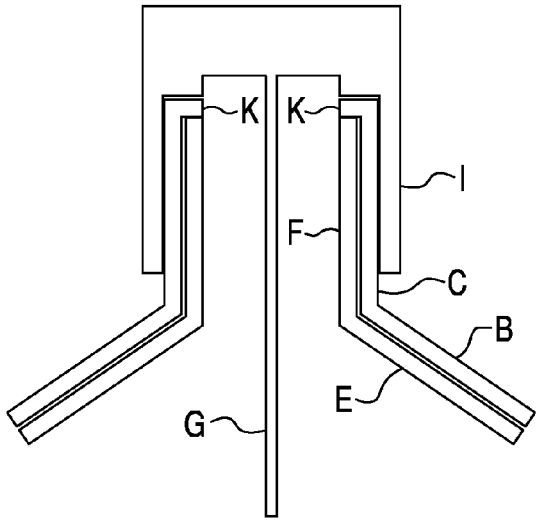
FIG. 9*c* is a cross-sectional view of the outer and inner shoulder and neck of the container (with the collar) configuration showing the spine and the cap and illustrates the embodiment of the neck of the inner tube fitting snugly against the collar.
Figure 9D:
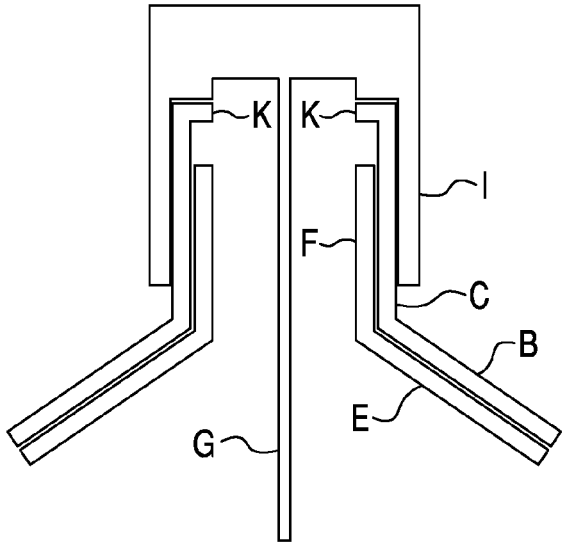
FIG. 9*d* is a cross-sectional view of the outer and inner shoulder and neck of the container (with the collar) configuration showing the spine and the cap and illustrates the embodiment of the neck of the inner tube not quite reaching the collar.

Reference letter A pertains to the wall of the outer tube.

Reference letter B pertains to the shoulder of the outer tube.

Reference letter C pertains to the neck of the outer tube.

Reference letter D pertains to the wall of the inner tube.

Reference letter E pertains to the shoulder of the inner tube.

Reference letter F pertains to the neck of the inner tube.

Reference letter G pertains to the spine of the inner tube.

Reference letter H pertains to the optional extensions of the spine of the inner tube.

Reference letter I pertains to the single closure for the inner and outer tubes.

Reference letter J pertains to the preferable optional extension of the spine of the inner tube.

Reference letter K pertains to the collar on the neck of the outer tube.

The above embodiments are to be understood as illustrative and non-limiting examples of the invention. It is to be understood that any feature described in relation to any one embodiment may be used alone, or in combination with other features described, and may also be used in combination with one or more features of any other of the embodiments. Furthermore, equivalents and modifications not described above may also be employed without departing from the spirit of the invention, which is defined in the accompanying claims.

What is claimed is:

1. A dual-compartment dispensing container for retaining and dispensing two separate products or product phases such that each product or product phase is concurrently dispensed from each compartment in substantially equal volumetric amounts, wherein said container comprises a first inner compartment comprising a deformable semi-circular inner tube formed from a semi-circular wall, which wall has a first edge and a second edge, and a flat wall opposed against said first and second edges to form a first cavity, said inner tube having a top end and a bottom end, said inner tube being disposed within a second outer compartment comprising a deformable fully circular outer tube having a circular wall, and forming a second cavity, said outer tube having a top end and a bottom end, such that:

(a) the semi-circular wall of the inner tube conforms to and abuts the circular wall of the outer tube;

(b) the semi-circular wall of the inner tube is more readily deformable than the circular wall of the outer tube;

(c) at the top end of the inner tube, the semi-circular wall thickens into a rigid first fully circular shoulder section that terminates in a first neck portion having an outer diameter and an inner diameter, said first neck portion having an opening that communicates with the first cavity of the inner tube;

(d) at the top end of the outer tube, the circular wall thickens into a rigid second fully circular shoulder section that terminates in a second neck portion having an outer diameter and an inner diameter, said second neck portion having an opening that communicates with the second cavity of the outer tube;

(e) the outer diameter of the first neck portion of the inner tube is greater than the inner diameter of the second neck portion of the outer tube such that the first neck portion of the inner tube press-fits or friction-fits into the second neck portion of the outer tube, thereby causing the inner tube to be held firmly in place within the outer tube;

(f) the flat wall of the inner tube constitutes a spine that has: (i) a thickness greater than the thickness of the semi-circular wall of the inner tube; (ii) a width substantially equal to an internal diameter of the outer tube below the second shoulder of the outer tube; (iii) a width which follows a cross-sectional width of the first shoulder and neck potions of the inner tube; and (iv) a length which is substantially equal to the length of the container, thereby dividing both the inner and outer compartments into two substantially equal portions.

2. The container of claim 1 wherein the first neck of the inner tube fits completely through the second neck of the outer tube such that the top of the first neck of the inner tube and the second neck of the outer tube are aligned.

3. The container of claim 1 wherein the second neck of the outer tube terminates in a collar that reduces the size of the opening of the container such that the first neck of the inner tube fits through the second neck of the outer tube but does not reach the collar of the outer tube.

4. The container of claim 1 wherein the second neck of the outer tube terminates in a collar that reduces the size of the opening of the container such that the first neck of the inner tube fits through the second neck of the outer tube until a top of the first neck of the inner tube abuts the collar of the outer tube.

5. The container of claim 4 wherein an opening in the first neck of the inner tube has substantially the same or greater diameter than an opening through the collar of the outer tube and the length of the first neck in the inner tube is shorter than the length of the second neck of the outer tube by an amount substantially equal to or greater than the thickness of the collar.

6. The container of claim 4 wherein the spine extends beyond the top of the collar of the outer tube by an amount in the range of about 0.001 to 0.060 inch so as to insure that a barrier is present to fully separate the two compartments when the closure is in place and the container is sealed.

7. The container of claim 1 including a singular closure comprising a screw-top or flip-top cap that fits over the first and second necks of the inner and outer tubes.

8. The container of claim 1 wherein the spine extends beyond the top of the second neck of the outer tube by an amount in the range of about 0.001 to 0.060 inch so as to insure that a barrier is present to fully separate the two compartments when the closure is in place and the container is sealed.

9. The container of claim 1 wherein each compartment is filled with each separate product or product phase through bottom openings of the inner and outer tubes and the inner and outer tubes are thereafter simultaneously crimped-closed and sealed to form a permanent closure on the bottoms of the inner and outer tubes.

10. The container of claim 1 wherein the inner tube comprises a thermoplastic polymer.

11. The container of claim 10 wherein the inner tube is fabricated as a single unit by injection molding.

12. The container of claim 1 wherein the outer tube is comprised of a thermoplastic polymer.

13. The container of claim 1 wherein the outer tube is comprised of aluminum laminated with a thermoplastic polymer.

14. The container of claim 1 wherein the thickness of the wall of the outer tube is in the range of about 0.010 to 0.030 inch.

15. The container of claim 1 wherein the shoulder of the inner tube has a thickness in the range of about 0.010 to 0.060 inch.

16. The container of claim 1 wherein the semi-circular wall of the inner tube below the shoulder has a thickness in the range of about 0.006 to 0.025 inch.

17. The container of claim 1 wherein the spine has a thickness in the range of about 0.010 to 0.045 inch.

18. The container of claim 1 wherein the spine contains at least one extension on each side of the spine to thereby prevent product or product phase migration from the outer tube to the area behind the semi-circular wall of the inner tube adjacent to the circular wall of the outer tube.

19. The container of claim 18 wherein the extensions fold away from the spine and have a width at the bottom of the outer tube substantially equal to one-half of the circumference of the outer tube.

* * * * *